US009845445B2

(12) United States Patent
Li et al.

(10) Patent No.: US 9,845,445 B2
(45) Date of Patent: Dec. 19, 2017

(54) CLEANING COMPOSITIONS COMPRISING ALKOXYLATED POLYALKYLENEIMINE, ORGANOMODIFIED SILICONE AND SILIXANE-BASED DILUENT

(71) Applicant: The Procter & Gamble Company, Cincinnati, OH (US)

(72) Inventors: Fei Li, Beijing (CN); Yu Zhao, Beijing (CN); Rajan Keshav Panandiker, West Chester, OH (US); Bernard William Kluesener, Harrison, OH (US); Rebecca Ann Langevin, Norwood, OH (US); Sherri Lynn Randall, Hamilton, OH (US); Gang Si, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 59 days.

(21) Appl. No.: 14/634,923

(22) Filed: Mar. 2, 2015

(65) Prior Publication Data

US 2015/0322380 A1 Nov. 12, 2015

Related U.S. Application Data

(63) Continuation of application No. PCT/CN2015/073284, filed on Feb. 26, 2015.

(60) Provisional application No. 61/991,649, filed on May 12, 2014, provisional application No. 62/028,965, filed on Jul. 25, 2014, provisional application No. 62/044,447, filed on Sep. 2, 2014.

(51) Int. Cl.

| | |
|---|---|
| ***C11D 1/02*** | (2006.01) |
| ***C11D 3/16*** | (2006.01) |
| ***C11D 3/30*** | (2006.01) |
| ***C11D 1/66*** | (2006.01) |
| ***C11D 3/00*** | (2006.01) |
| ***C11D 3/37*** | (2006.01) |
| ***C11D 1/722*** | (2006.01) |
| ***C11D 1/22*** | (2006.01) |
| ***C11D 1/72*** | (2006.01) |
| ***C11D 1/14*** | (2006.01) |
| ***C11D 1/88*** | (2006.01) |
| ***C11D 3/12*** | (2006.01) |

(52) U.S. Cl.

CPC ..... *C11D 1/66* (2013.01); *C11D 1/14* (2013.01); *C11D 1/22* (2013.01); *C11D 1/72* (2013.01); *C11D 1/722* (2013.01); *C11D 1/88* (2013.01); *C11D 3/0026* (2013.01); *C11D 3/124* (2013.01); *C11D 3/162* (2013.01); *C11D 3/30* (2013.01); *C11D 3/373* (2013.01); *C11D 3/3723* (2013.01); *C11D 3/3738* (2013.01)

(58) Field of Classification Search

CPC .... C11D 1/14; C11D 1/22; C11D 1/72; C11D 1/722; C11D 1/75; C11D 1/90; C11D 3/0026; C11D 3/124; C11D 3/162; C11D 3/30; C11D 3/3723; C11D 11/0017; C11D 11/0023; B08B 3/04

USPC ..... 510/336, 337, 466, 499; 134/25.2; 8/137

See application file for complete search history.

(56) References Cited

U.S. PATENT DOCUMENTS

| | | | | |
|---|---|---|---|---|
| 5,723,426 | A | 3/1998 | Zhen et al. | |
| 5,759,208 | A | 6/1998 | Zhen et al. | |
| 6,075,000 | A | 6/2000 | Rohrbaugh et al. | |
| 6,521,586 | B1 * | 2/2003 | Hoogland | B01D 19/0404 510/347 |
| 7,566,750 | B2 | 7/2009 | Rautschek et al. | |
| 7,619,043 | B2 | 11/2009 | Rautschek et al. | |
| 7,820,610 | B2 | 10/2010 | Showell et al. | |
| 8,093,202 | B2 | 1/2012 | Danziger et al. | |
| 8,097,579 | B2 | 1/2012 | Danziger et al. | |
| 8,247,368 | B2 | 8/2012 | Danziger et al. | |
| 8,318,653 | B2 | 11/2012 | Misske et al. | |
| 8,536,109 | B2 | 9/2013 | Delbrassinne et al. | |
| 8,603,961 | B2 | 12/2013 | Panandiker et al. | |
| 2011/0020929 | A1 | 1/2011 | Schober et al. | |
| 2011/0237486 | A1 | 9/2011 | Souter et al. | |
| 2011/0294714 | A1 * | 12/2011 | Delbrassinne | B01D 19/0404 510/343 |
| 2015/0240187 | A1 * | 8/2015 | Scheibel | C07C 303/14 510/498 |

FOREIGN PATENT DOCUMENTS

WO WO 2012/075685 A1 6/2012

OTHER PUBLICATIONS

U.S. Appl. No. 14/631,908, filed Feb. 26, 2015, Rajan Keshav Panandiker, et al.

Search Report for International Application No. PCT/CN2015/073284, dated May 11, 2016, 12 pages.

* cited by examiner

*Primary Examiner* — Gregory R Delcotto

(74) *Attorney, Agent, or Firm* — Gregory S. Darley-Emerson; Leonard W. Lewis; Steve W. Miller

(57) ABSTRACT

The present invention relates to cleaning compositions with improved rinse suds profile, which comprise an alkoxylated polyalkyleneimine, an organomodified silicone and a siloxane-based diluent.

22 Claims, No Drawings

CLEANING COMPOSITIONS COMPRISING ALKOXYLATED POLYALKYLENEIMINE, ORGANOMODIFIED SILICONE AND SILIXANE-BASED DILUENT

FIELD OF THE INVENTION

The present invention relates to cleaning products, and preferably to liquid laundry or dish detergent products. The cleaning products of the present invention contain an alkoxylated polyalkyleneimine, an organomodified silicone and a siloxane-based diluent, which in combination exhibit surprising and unexpected improvements in their ability to reduce suds during the rinse cycle of a cleaning process.

BACKGROUND OF THE INVENTION

Surfactants in detergent products typically create a significant volume of suds during wash. During subsequent rinsing steps, the suds and excessive surfactants are rinsed off together with soil and other debris.

Sudsing profile of a detergent composition is important for the consumer experience, where the appropriate volume and speed of suds formation, retention and disappearance in the wash and rinse cycles are considered key benchmarks of cleaning performance by the consumers.

A large volume of suds is initially desirable, especially during a hand washing process where the user is directly involved with the wash, feeling and touching the suds generated by the detergent composition. Copious suds during the wash is viewed by the consumers as the primary and most desirable signal of cleaning, as it indicates to the user that sufficient surfactant is present, working to clean the articles (e.g., fabric or dishes).

Paradoxically, while a large volume of suds is desirable during the wash cycle of a cleaning process, it is nevertheless undesirable during the rinse cycle. If a high volume of suds is still present during the rinse cycle, the consumers immediately infer from it that there may still be surfactant residue left on the articles and that the articles are not yet "clean". As a result, the consumers will feel the need to rinse multiple times until the suds completely disappear. Sometimes, it can take between 3-6 rinses in order to remove such suds to the satisfaction of the consumer. This adds up to a greater consumption of water. Typically, about 5-10 tons of water is consumed per year per household in countries such as India and China, where habits of hand-washing fabric or dishes are more prevalent than machine-washing. Because water is often a limited resource, especially in those hand-washing countries, the excess amount of water consumed by multiple rinses reduces the amount of water available for other possible uses, such as irrigation, drinking, bathing, etc.

However, it has been found that fewer rinses can sufficiently remove surfactants, and thus multiple rinses are not necessary. Therefore, if the above-described consumer perception can be successfully overcome, the number of rinsing can be reduced with little or no adverse effects to the end cleaning result.

Various foam-control or anti-foaming agents have been added to detergent or cleaning compositions to control and reduce suds volume. For example, U.S. Pat. No. 8,536,109 (Dow Corning) discloses a foam control composition that contains a silicone anti-foam dispersed in an organopolysiloxane resin, wherein the silicone anti-foam includes an organopolysiloxane, an organosilicon resin, and a hydrophobic filler; U.S. Pat. No. 7,566,750 (Wacker) discloses a defoamer composition containing an organopolysiloxane, filler particles and/or an organopolysiloxane resin, and a very minor amount of added water, which is more effective in reducing the foam or suds volume.

There is a continuing need for improved foam control or anti-foaming agents that can further reduce suds, especially those that can more effectively suppress or kill suds during the rinse cycle of a cleaning process, to thereby minimize the amount of water needed for rinse, and preferably to enable "single rinse" of the to-be-cleaned article. Cleaning compositions containing such improved foam control or anti-foaming agents are particularly desirable for cost saving and environmental conservation purposes.

SUMMARY OF THE INVENTION

The present invention discovers that a cleaning composition, especially a liquid detergent composition, which contains the combination of an alkoxylated polyalkyleneimine with an organomodified silicone having one or more aryl moieties and a siloxane-based diluent having a Solubility Index of from about 0.8 to about 1.25 in the organomodified silicone (measured according to the test method described hereinafter), exhibits surprising and unexpected synergistic effect in reducing rinse suds volume.

In one aspect, the present invention relates to a cleaning composition containing:

(a) an alkoxylated polyalkyleneimine comprising a polyalkyleneimine core and at least one side chain bonded to a nitrogen atom in the polyalkyleneimine core, while the polyalkyleneimine core has an average number-average molecular weight (MWn) ranging from about 100 to about 100,000 Daltons, and such at least one side chain has an empirical formula (I) of:

$$-(EO)_b(PO)_c—R \quad (I)$$

while EO is ethylene oxide; b has a weight average value ranging from about 3 to about 60; PO is propylene oxide; c has a weight average value ranging from 0 to about 60; R is selected from the group consisting of hydrogen, $C_1$-$C_4$ alkyls, and combinations thereof;

(b) an organomodified silicone comprising one or more aryl moieties each including a 5- to 9-membered aromatic ring, while the aromatic ring can be either substituted or unsubstituted, either heteroatomic or homoatomic, either monocyclic or multicyclic; and (c) a siloxane-based diluent having a Solubility Index of from about 0.8 to about 1.25 in the organomodified silicone.

In a preferred embodiment of the present invention, the cleaning composition further contains hydrophobically modified silica, a silicone resin, and optionally an emulsifier.

The cleaning composition of the present invention may further contain one or more surfactants selected from the group consisting of anionic surfactants, nonionic surfactants, cationic surfactants, amphoteric surfactants, zwitterionic surfactants, and combinations thereof. The cleaning composition of the present invention preferably forms a fabric and home care product, preferably a liquid detergent product, and more preferably a liquid laundry or dish detergent product.

In another aspect, the present invention relates to a liquid detergent composition containing:

(a) from about 1 wt % to about 5 wt % of an alkoxylated polyalkyleneimine comprising a polyalkyleneimine core and at least one side chain bonded to a nitrogen atom in the polyalkyleneimine core, while the polyalkyleneimine core has an average number-average molecular weight (MWn) ranging from about 200 to about 1000 Daltons, and while the at least one side chain has an empirical formula (I) of $-(EO)_b(PO)_c—R$, given that EO is ethylene oxide; b has a weight average value ranging from about 20 to about 30; PO is propylene oxide; c has a weight average value ranging from about 10 to about 30; and R is hydrogen;

(b) from about 0.02 wt % to about 0.5 wt % of an organomodified silicone, which contains from about 10 mol % to about 40 mol % of siloxane units containing a 2-phenylpropyl moiety and from about 3 mol % to about 10 mol % of siloxane units containing a $C_6$-$C_{10}$ alkyl moiety;

(c) from about 0.02 wt % to about 0.5 wt % of a siloxane-based diluent having a Solubility Index of from about 0.85 to about 1 in the afore-mentioned organomodified silicone;

(d) from about 0.002 wt % to about 0.05 wt % of a hydrophobically modified silica;

(e) from about 0.002 wt % to about 0.05 wt % of a silicone resin;

(f) from about 5 wt % to about 30 wt % of an anionic surfactant;

(g) optionally, from about 0.5 wt % to about 20 wt % of an amphoteric surfactant and/or zwitterionic surfactant;

(h) optionally, from about 0.1 wt % to about 10 wt % of a nonionic surfactant; and (i) water.

Still another aspect of the present invention relates to the use of the liquid detergent composition as described hereinabove for washing fabric or dishes, and preferably for hand-washing fabric or dishes, to achieve optimized rinse sudsing profile.

These and other features of the present invention will become apparent to one skilled in the art upon review of the following detailed description when taken in conjunction with the appended claims.

DETAILED DESCRIPTION OF THE INVENTION

Definitions

As used herein, the articles "a" and "an" when used in a claim, are understood to mean one or more of what is claimed or described.

As used herein, the terms "comprising," "comprises," "include", "includes" and "including" are meant to be non-limiting.

As used herein, the term "substantially free of" or "substantially free from" means that the indicated material is present in an amount of no more than about 5 wt %, preferably no more than about 2%, and more preferably no more than about 1 wt %.

As used therein, the term "essentially free of" or "essentially free from" means that the indicated material is at the very minimal not deliberately added to the composition, or preferably not present at an analytically detectible level in such composition. It may include compositions in which the indicated material is present only as an impurity of one or more of the materials deliberately added to such compositions.

As used herein, the term "solid" includes granular, powder, bar and tablet product forms.

As used herein, the term "fluid" includes liquid, gel, paste and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$.

All temperatures herein are in degrees Celsius (° C.) unless otherwise indicated. Unless otherwise specified, all measurements herein are conducted at 25° C. and under the atmospheric pressure.

As used herein the phrase "detergent composition," "cleaning composition" or "detergent or cleaning composition" includes compositions and formulations designed for cleaning soiled material. Such compositions include but are not limited to, laundry detergent compositions, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-cleaning treatment, a post-cleaning treatment, or may be added during the rinse or wash cycle of the cleaning process. The cleaning compositions may have a form selected from liquid, powder, single-phase or multi-phase unit dose or pouch form (e.g., a liquid detergent composition that is contained in a single compartment or multi-compartment water-soluble pouch, e.g., formed by a water-soluble polymer such as poly-vinyl alcohol (PVA) or copolymers thereof), tablet, gel, paste, bar, or flake. In a preferred embodiment of the present invention, the detergent or cleaning composition of the present invention is a liquid laundry or dish detergent composition, which is designated for either hand-washing or machine-washing of fabric or dishes. More preferably, the detergent or cleaning composition of the present invention is a liquid laundry or dish detergent composition designated for hand-washing purposes.

As used herein, "suds" indicates a non-equilibrium dispersion of gas bubbles in a relatively smaller volume of a liquid. The terms like "suds", "foam" and "lather" can be used interchangeably within the meaning of the present invention.

As used herein, "sudsing profile" refers to the properties of a cleaning composition relating to suds character during the wash and/or rinse cycles. The sudsing profile of a cleaning composition includes, but is not limited to, the speed of suds generation upon dissolution in the wash liquor, the volume and retention of suds in the wash cycle, and the volume and disappearance of suds in the rinse cycle.

Unless otherwise specified, the term "molecular weight" as used herein refers to the weight average molecular weight (MWw) of the polymer chains in a polymer composition, which may be calculated using the equation:

$$MWw=(\Sigma i\ Ni\ Mi^2)/(\Sigma i\ Ni\ Mi)$$

wherein Ni is the number of molecules having a molecular weight Mi.

The term "average number-average molecular weight (MWn)" as used herein is calculated using the equation:

$$MWn=(\Sigma i\ Ni\ Mi)/(\Sigma i\ Ni)$$

wherein Ni is the number of molecules having a molecular weight Mi.

As used herein "mol %" refers to the relative molar percentage of a particular monomeric structural unit in a polymer. It is understood that within the meaning of the present invention, the relative molar percentages of all monomeric structural units that are present in the cationic polymer shall add up to 100 mol %.

As used herein, term "substituted" is defined herein as encompassing moieties or units which can replace a hydrogen atom, two hydrogen atoms, or three hydrogen atoms of a hydrocarbyl moiety, inter alia, aromatic ring, alkyl chain, and the like. When a moiety is described a "substituted" any number of the hydrogen atoms may be replaced. For example, a substituted unit that requires a single hydrogen atom replacement includes halogen, hydroxyl, and the like. A two hydrogen atom replacement includes carbonyl, oximino, and the like. A two hydrogen atom replacement from adjacent carbon atoms includes epoxy, and the like. A three hydrogen replacement includes cyano, and the like. An epoxide unit is an example of a substituted unit which requires replacement of a hydrogen atom on adjacent carbons. Also substituted can include replacement of hydrogen atoms on two adjacent carbons to form a new moiety or unit.

Unless otherwise specified, the term "alkyl" as used herein means a $C_1$-$C_{10}$ hydrocarbyl moiety which can be linear or branched, substituted or unsubstituted.

As used herein, the term "hydrocarbyl" is defined herein as any organic unit or moiety which is comprised of carbon atoms and hydrogen atoms. Included with the definition of "hydrocarbyl" are the aromatic (aryl) and non-aromatic carbocyclic rings. Further included within the term hydrocarbyl are heterocycles. The term "heterocycle" includes both aromatic (heteroaryl) and non-aromatic heterocyclic rings.

In all embodiments of the present invention, all percentages are by weight of the total composition, unless specifically stated otherwise. All ratios are weight ratios, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It is understood that the test methods that are disclosed in the Test Methods Section of the present application must be used to determine the respective values of the parameters of Applicants' inventions are described and claimed herein.

Alkoxylated Polyalkyleneimine

The cleaning composition of the present invention contains at least one, and preferably two or more, alkoxylated polyalkyleneimine.

The alkoxylated polyalkylenimines of the present invention may be represented as containing repeating units of formulae (1), (2), (3) and (4)

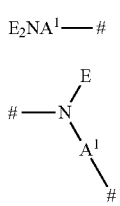

(1)

(2)

-continued (3)

(4)

wherein:

in each case denotes one-half of a bond between a nitrogen atom and the free binding position of a group $A^1$ of two adjacent repeating units of formulae (1), (2), (3) or (4);

$A^1$ is independently selected from linear or branched $C_2$-$C_6$ alkylene;

E is independently selected from alkylenoxy units of the formula (5):

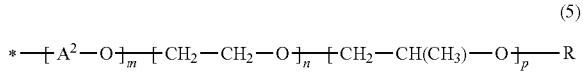

(5)

wherein:

* in each case denotes the bond to the nitrogen atom of the repeating unit of formula (1), (2) or (4);

$A^2$ is in each case independently selected from 1,2-propylene, 1,2-butylene and 1,2-isobutylene;

R is in each case independently selected from hydrogen and $C_1$-$C_4$-alkyl;

m has an average value in the range of from 0 to about 2;

n has an average value in the range of from about 20 to about 50; and p is a rational number from about 10 to about 50;

the individual alkoxylated polyalkylenimines consisting of 1 repeating unit of formula (1), x repeating units of formula (2), y repeating units of formula (3) and y+1 repeating units of formula (4), wherein x and y in each case have a value in the range of from 0 to about 150; and the polymer has a degree of quaternization of from 0 to about 50%. For more information regarding the alkoxylated polyalkyleneimines, please see U.S. Pat. No. 8,097,579B and WO2006/108856A1.

In a simplified representation, the alkoxylated polyalkyleneimines of the present invention can be considered as having a polyalkyleneimine core and at least one side chain bonded to a nitrogen atom in the polyalkyleneimine core.

The polyalkyleneimine core is formed by the repeating units of formulae (1), (2), (3) and (4) as described hereinabove, but minus the alkylenoxy units E. The polyalkyleneimine core of the alkoxylated polyalkyleneimine of the present invention has an average number-average molecular weight (MWn) ranging from about 100 to about 100,000 Daltons, preferably from about 100 to about 5000 Daltons, and more preferably from about 200 to about 1000 Daltons.

The at least one side chain of the alkoxylated polyalkyleneimine, which is formed by the alkylenoxy units E as described hereinabove, preferably has an inner polyethylene oxide block and an outer polypropylene oxide block, which can be represented by an empirical formula (I) of:

$$-(EO)_b(PO)_c—R \quad (I)$$

while EO is ethylene oxide; b has a weight average value ranging from about 3 to about 60; PO is propylene oxide; c has a weight average value ranging from 0 to about 60; R is selected from the group consisting of hydrogen, $C_1$-$C_4$ alkyls, and combinations thereof.

In a preferred embodiment of the present invention, the cleaning composition contains a first alkoxylated polyalkyleneimine having a polyalkyleneimine core with Mwn ranging from about 100 to about 5000 Daltons, and preferably from about 200 to about 1000 Daltons; b ranges from about 10 to about 50, preferably from about 15 to about 40, more preferably from about 20 to about 30; and wherein c ranges from about 1 to about 50, preferably from about 5 to about 40, and more preferably from about 10 to about 30. Said first alkoxylated polyalkyleneimine can be represented by an empirical formula of $(PEI)_{200-1000}(EO)_{20-30}(PO)_{10-30}$.

Preferably but not necessarily, the cleaning composition may further contain a second alkoxylated polyalkyleneimine having a polyalkyleneimine core with Mwn ranging from about 100 to about 5000 Daltons, and preferably from about 200 to about 1000 Daltons; b ranges from about 5 to about 40, preferably from about 10 to about 30, more preferably from about 15 to 25; and wherein c is 0. Said second alkoxylated polyalkyleneimine can be represented by an empirical formula of $(PEI)_{200-1000}(EO)_{15-25}$. The weight ratio between such first and second alkoxylated polyalkyleneimines may range from about 1:10 to about 10:1, preferably from about 1:5 to about 5:1, and more preferably from about 1:2 to about 2:1.

The above-described alkoxylated polyalkyleneimine(s) may be present in the cleaning composition of the present invention in an amount ranging from about 0.01 wt % to about 20 wt %, preferably from about 0.05 wt % to about 15 wt %, more preferably from about 0.1 wt % to about 10 wt %, and most preferably from about 0.5 wt % to about 5 wt %. In a particularly preferred embodiment of the present invention, the cleaning composition contains from about 0.1 wt % to about 5 wt % of the first alkoxylated polyalkyleneimine, and from 0 wt % to about 2 wt % of the second alkoxylated polyalkyleneimine.

Organomodified Silicone Comprising Aryl Moieties

The cleaning composition of the present invention further contains an organomodified silicone comprising one or more aryl moieties each comprising a 5- to 9-membered aromatic ring. Such an aromatic ring can be either substituted or unsubstituted, either heteroatomic or homoatomic, either monocyclic or multicyclic. For example, the aromatic ring can be selected from the group consisting of phenyl, furan, pyrrole, thiophene, imidazole, pyrazole, oxazole, pyridine, pyrazine, naphthalene, anthracene moieties, and derivatives thereof. Preferably, the aromatic ring is substituted with at least one aliphatic group. In a particularly preferred embodiment of the present invention, such one or more aryl moieties are selected from alkylphenyl moieties, and more preferably such one or more aryl moieties are 2-phenylpropyl moieties, which is also commonly referred to as alpha-methylstyrene moieties.

The organomodified silicone may further comprise one or more $C_2$-$C_{20}$ aliphatic moieties, and preferably one or more $C_6$-$C_{10}$ alkyl moieties, which can be either substituted or unsubstituted, either heteroatomic or homoatomic.

Said organomodified silicone may comprise units of the following formula (II):

$$R_a(R^1O)_bR^2_cSiO_{(4-a-b-c)/2} \quad \text{(II)}$$

wherein:

a) each R is independently selected from the group consisting of: H; the aryl moieties as described hereinabove, which contain a substituted aromatic ring with at least one aliphatic group and is covalently attached to a silicon atom of the organomodified silicone via the aliphatic groups; and a monovalent, SiC-bonded aliphatic hydrocarbon radical, which is optionally substituted and optionally comprises a heteroatom;

b) each $R^1$ is independently selected from the group consisting of: H; and a monovalent aliphatic hydrocarbon radical, which is optionally substituted and optionally comprises a heteroatom;

c) each $R^2$ is independently selected from the group consisting of: H; the aryl moieties as described hereinabove, which contain a substituted aromatic ring with at least one aliphatic group and is covalently attached to a silicon atom of the organomodified silicone via the aliphatic groups; the aryl moieties as described hereinabove, which contain a substituted artomic ring and is covalently attached to a silicon atom of the organomodified silicone via a carbon ring atom; and a monovalent, SiC-bonded aliphatic hydrocarbon radical, which is optionally substituted and optionally comprises a heteroatom;

d) the index a is 0, 1, 2 or 3;

e) the index b is 0, 1, 2 or 3; and f) the index c is 0, 1, 2 or 3.

The sum of a+b+c is typically less than or equal to 3, and it is preferably an average of from about 1.5 to about 2.4, more preferably an average of from about 1.8 to about 2.3, and most preferably from about 1.9 to about 2.1. The organomodified silicone may comprise from about 5 to about 10,000, preferably from about 10 to about 5,000, and more preferably from about 50 to about 1,000, and most preferably from about 100 to about 500, siloxane units of formula (I).

In a preferred embodiment of the present invention, the organomodified silicone comprises a sufficient number of R and $R^2$ moieties that comprise the preferred aryl moieties to provide from about 1 mol % to about 75 mol % of siloxane units with 2-phenylpropyl moieties attached thereto and from about 1 mol % to about 20 mol % of siloxane units with $C_6$-$C_{10}$ alkyl moieties attached thereto, provided that none of the 2-phenylpropyl moieties and none of the $C_6$-$C_{10}$ alkyl moieties are attached to the same silicon atom. More preferably, the organomodified silicone contains from about 5 mol % to about 50 mol % or from about 10 mol % to about 40 mol % of siloxane units with 2-phenylpropyl moieties attached thereto, and from about 2 mol % to about 15 mol % or from about 3 mol % to about 10 mol % of siloxane units with $C_6$-$C_{10}$ alkyl moieties attached thereto. Most preferably, the organomodified silicone contains from about 15 mol % to about 25 mol % of the 2-phenylpropyl moieties and from about 4 mol % to about 8 mol % of $C_6$-$C_{10}$ alkyl moieties. Please note that the total mol % of all siloxane units, either substituted or unsubstituted, in the organomodified silicone adds to 100 mol %.

The weight average molecular weight (MWw) of the organomodified silicone of the present invention may range from about 1,000 to about 500,000, preferably from about 5,000 to about 200,000, more preferably from about 10,000 to about 150,000, and most preferably from about 50,000 to about 100,000, Daltons. The number average molecular weight of the organomodified silicone of the present invention may range from about 1,000 to about 500,000, preferably from about 2,000 to about 200,000, more preferably from about 5,000 to about 100,000, and most preferably from about 10,000 to about 50,000, Daltons.

The organomodified silicone can be present in the cleaning composition of the present invention in an amount ranging from about 0.001 wt % to about 10 wt %, preferably from about 0.005 wt % to about 5 wt %, more preferably from about 0.01 wt % to about 2 wt %, and most preferably from about 0.02 wt % to about 0.5 wt %.

Siloxane-Based Diluent

The cleaning composition of the present invention further contains a siloxane-based diluent that is characterized by a Solubility Index (calculated according to the Solubility Index Test described hereinafter) of from about 0.8 to about 1.25 in the above-described organomodified silicone. Preferably, the siloxane-based diluent is characterized by a Solubility Index of from about 0.85 to about 1.2, more preferably from about 0.9 to about 1.1, and most preferably from about 0.95 to about 1.0.

In a preferred but not necessary embodiment of the present invention, the siloxane-based diluent contains one or more polydimethylsiloxanes (PDMS) having viscosity ranging from about 0.5 cSt to about 10,000 cSt, preferably from about 1 cSt to about 1,000 cSt, more preferably from about 2 cSt to about 100 cSt, and most preferably from about 5 cSt to about 15 cSt, measured at a shear rate of 20 $sec^{-1}$ and 25° C. The PDMS can be linear, branched, cyclic, grafted or cross-linked or cyclic structures, while linear PDMS is particularly preferred.

The siloxane-based diluent can be present in the cleaning composition of the present invention in an amount ranging from about 0.001 wt % to about 10 wt %, preferably from about 0.002 wt % to about 5 wt %, more preferably from about 0.01 wt % to about 2 wt %, and most preferably from about 0.02 wt % to about 0.5 wt %.

In a particularly preferred embodiment of the present invention, the siloxane-based diluent may contain a combination of two or more PDMSs of different viscosity. For example, the siloxane-based diluent may include a first polydimethylsiloxane having a first, higher viscosity of from about 8 cSt to about 12 cSt and a second polydimethylsiloxane having a second, lower viscosity of from about 5 cSt to about 10 cSt, when measured at a shear rate of about 20 $sec^{-1}$ and about 25° C. Specifically, it is preferred that the first PDMS is present in an amount ranging from about 0.001 wt % to about 10 wt %, preferably from about 0.002 wt % to about 2.5 wt %, more preferably from about 0.01 wt % to about 1 wt %, and most preferably from about 0.02 wt % to about 0.25 wt % by total weight of the detergent or cleaning composition; and the second polydimethylsiloxane is present in an amount ranging from 0% to about 10 wt %, preferably from about 0.002 wt % to about 2.5 wt %, more preferably from about 0.01 wt % to about 1 wt %, and most preferably from about 0.02 wt % to about 0.25 wt % by total weight of the cleaning composition. More preferably, the weight ratio of the first PDMS over the second PDMS is preferably greater than about 1:1.

Hydrophobic Silica

In a preferred but not necessary embodiment of the present invention, the cleaning composition further comprises hydrophobically modified silica particles. Such hydrophobically modified silica particles may have: (1) a surface area as measured by BET measurement of from about 50 $m^2/g$ to about 800 $m^2/g$, preferably from about 80 to about 200 $m^2/g$; and (2) an average particle size ranging from about 0.5 to about 50 microns, preferably from about 1 to about 40 microns, more preferably from about 2 to about 30 microns, and most preferably from about 5 to about 25 microns.

Silica particles are typically not hydrophobic in nature, so the hydrophobically modified silica particles are formed by surface treatment of silica particles with a hydrophobing agent. The silica particles are preferably those prepared by heating, e.g., fumed silica, or by precipitation, or by a sol-gel process, while precipitated silica particles are particularly preferred. Suitable hydrophobing agents include, but are not limited to: methyl substituted organosilicone materials, fatty acids, polydimethylsiloxanes, dimethylsiloxane polymers that are end-blocked with silanol or silicon-bonded alkoxy groups, hexamethyldisilazane, hexamethyldisiloxane, and organosilicone resins. Hydrophobing of the silica particles are typically carried out at a temperature of at least 80° C. Commercially available hydrophobic silica particles include those sold under the trade names Sipernat®D10 or Sipernat®D13 from Degussa AG, Germany.

The hydrophobic silica can be present in the detergent or cleaning composition of the present invention in an amount ranging from about 0.0001 wt % to about 1 wt %, preferably from about 0.0004 wt % to about 0.5 wt %, more preferably from about 0.001 wt % to about 0.15 wt %, and most preferably from about 0.002 wt % to about 0.05 wt %.

Silicone Resin

Preferably but not necessarily, the cleaning composition of the present invention may further comprise a silicone resin. The silicone resin may comprise units of formula (III) below:

$$R^3_d(R^4O)_eSiO_{(4-d-e)/2} \quad \text{(III)}$$

wherein:

a) each $R^3$ is independently selected from the group consisting of: H; a monovalent, SiC-bonded, aliphatic hydrocarbon radical that is optionally substituted and optionally comprises a heteroatom; and an aromatic hydrocarbon radical that is covalently attached to a silicon atom of the silicone resin via aliphatic groups;

b) each $R^4$ is independently selected from the group consisting of: H; a monovalent aliphatic hydrocarbon radical that is optionally substituted and optionally comprises a heteroatom;

c) the index d is 0, 1, 2 or 3; and d) the index e is 0, 1, 2 or 3.

The sum of d+e is typically less than or equal to 3, and preferably less than about 30% or more preferably less than about 5% of all siloxane units of formula (III) in the silicone resin have the sum of d+e=2.

More preferably, the value of d is either 3 or 0. In this manner, the silicone resin of the present invention is composed essentially of $R^3_3SiO_{1/2}$ (M) units and $SiO_{4/2}$ (Q) units, while $R^3$ is as defined hereinabove. Such resins are typically referred to as MQ resins. The molar ratio of M units to Q units is preferably from about 0.5 to about 2.0, more preferably from about 0.6 to about 1.0. These MQ resins may also contain up to about 10% by weight of hydroxyl or alkoxy groups. Although it is preferred that the MQ resins are solid at room temperature, liquid MQ resins having a M/Q ratio of about 1.2 or higher can also be used successfully.

The silicone resin of the present invention is preferably provided as a solution containing a non-volatile solvent. Suitable non-volatile solvents include various oils, alcohols, and esters of carboxylic acids, such as fatty acid esters. Preferred solvents include esters of carboxylic acids, such as dioctyl phthalate, diethyl succinate, methyl caproate, butyl perlargonate, ethyl stearate, 2-ethylhexyl stearate, dodecyl laurate, methyl melissate, and the like.

For more details regarding the organomodified silicone, the siloxane-based diluent, the hydrophobically modified silica, the silicone resin, and the solvent, please see US2011/0209291, U.S. Pat. No. 7,566,750, and U.S. Pat. No. 8,536,109.

The silicone resin can be present in the cleaning composition of the present invention in an amount ranging from about 0.0001 wt % to about 1 wt %, preferably from about 0.0002 wt % to about 0.5 wt %, more preferably from about 0.001 wt % to about 0.1 wt %, and most preferably from about 0.002 wt % to about 0.05 wt %.

Solvent for the Silicone Resin

Preferably but not necessarily, the cleaning composition of the present invention may further comprise a solvent for the silicone resin. Suitable emulsifiers are non-volatile organic solvents, including alcohols such as dodecanol, 2-butyl-octanol and the like, or fatty acid esters such as octyl stearate, 2-ethylhexyl stearate and the like. A particularly preferred solvent is 2-ethylhexyl stearate.

The solvent can be present in the cleaning composition of the present invention in an amount ranging from 0 wt % to about 0.5 wt %, preferably from about 0.0002 wt % to about 0.2 wt %, more preferably from about 0.001 wt % to about 0.1 wt %, and most preferably from about 0.002 wt % to about 0.05 wt %.

Cleaning Compositions

The cleaning composition of the present invention can be personal care cleaners, such as those used in the health and beauty areas, including shampoos and soaps, which may benefit from products having improved rinse suds profiles. In another aspect, the cleaning composition is suitable for cleaning various hard surfaces, such as hard wood, tile, ceramic, plastic, leather, metal, glass, etc. The cleaning composition is also suitable to be used for dish washing, either as automatic machine dishwashing detergents or as hand-washing dish detergents. Further, the cleaning composition of the present invention is suitable for fabric cleaning application, including automatic machine washing or hand-washing of fabrics, or cleaning auxiliaries, such as for example, bleach, rinse aids, additives or pre-treat types.

The cleaning compositions can be in any form, namely, in the form of a liquid; a solid such as a powder, granules, agglomerate, paste, tablet, pouches, bar, gel; an emulsion; types delivered in dual- or multi-compartment containers or pouches; a spray or foam detergent; premoistened wipes (i.e., the cleaning composition in combination with a non-woven material); dry wipes (i.e., the cleaning composition in combination with a nonwoven materials) activated with water by a consumer; and other homogeneous or multiphase consumer cleaning product forms.

The cleaning composition is preferably a liquid laundry or dish detergent and can be a fully formulated laundry or dish detergent product. Liquid compositions contained in encapsulated and/or unitized dose products are included, as are compositions which comprise two or more separate but jointly dispensable portions. More preferably, the liquid detergent composition is a liquid laundry or dish detergent composition designed for hand-washing, where the improved suds benefit or superior sudsing profile is most evident to the consumer. The liquid laundry or dish detergent composition preferably contains water as an aqueous carrier, and it can contain either water alone or mixtures of organic solvent(s) with water as carrier(s). Suitable organic solvents are linear or branched lower $C_1$-$C_8$ alcohols, diols, glycerols or glycols; lower amine solvents such as $C_1$-$C_4$ alkanolamines, and mixtures thereof. Exemplary organic solvents include 1,2-propanediol, ethanol, glycerol, monoethanolamine and triethanolamine. The carriers are typically present in a liquid composition at levels in the range of from about 0.1% to about 98%, preferably from about 10% to about 95%, more preferably from about 25% to about 75% by total weight of the liquid composition. In some embodiments, water is from about 85 to about 100 wt % of the carrier. In other embodiments, water is absent and the composition is anhydrous. Highly preferred compositions afforded by the present invention are clear, isotropic liquids.

The liquid detergent composition of the present invention has a viscosity from about 1 to about 2000 centipoise (1-2000 mPa·s), or from about 200 to about 800 centipoises (200-800 mPa·s). The viscosity can be determined using a Brookfield viscometer, No. 2 spindle, at 60 RPM/s, measured at 25° C.

In addition to the ingredients described hereinabove, the cleaning compositions of the present invention may comprise one or more surfactants at amounts ranging from about 1% to about 80%, more preferably from about 1% to about 50%, and more preferably from about 5% to about 30% by total weight of the compositions. Detersive surfactants utilized can be of the anionic, nonionic, zwitterionic, amphoteric or cationic type or can comprise compatible mixtures of these types.

Anionic surfactants are preferred. Useful anionic surfactants can themselves be of several different types. For example, non-soap synthetic anionic surfactants are particularly suitable for use herein, which include the water-soluble salts, preferably the alkali metal, and ammonium salts, of organic sulfuric reaction products having in their molecular structure an alkyl group (included in the term "alkyl" is the alkyl portion of acyl groups) containing from about 10 to about 20 carbon atoms and a sulfonic acid or sulfuric acid ester group. Examples of this group of synthetic anionic surfactants include, but are not limited to: a) the sodium, potassium and ammonium alkyl sulfates with either linear or branched carbon chains, especially those obtained by sulfating the higher alcohols ($C_{10}$-$C_{20}$ carbon atoms), such as those produced by reducing the glycerides of tallow or coconut oil; b) the sodium, potassium and ammonium alkylethoxy sulfates with either linear or branched carbon chains, particularly those in which the alkyl group contains from about 10 to about 20, preferably from about 12 to about 18 carbon atoms, and wherein the ethoxylated chain has, in average, a degree of ethoxylation ranging from about 0.1 to about 5, preferably from about 0.3 to about 4, and more preferably from about 0.5 to about 3; c) the sodium and potassium alkyl benzene sulfonates in which the alkyl group contains from about 10 to about 20 carbon atoms in either a linear or a branched carbon chain configuration, preferably a linear carbon chain configuration; d) the sodium, potassium and ammonium alkyl sulphonates in which the alkyl group contains from about 10 to about 20 carbon atoms in either a linear or a branched configuration; e) the sodium, potassium and ammonium alkyl phosphates or phosphonates in which the alkyl group contains from about 10 to about 20 carbon atoms in either a linear or a branched configuration, f) the sodium, potassium and ammonium alkyl carboxylates in which the alkyl group contains from about 10 to about 20 carbon atoms in either a linear or a branched configuration, and combinations thereof; g) the sodium, potassium and ammonium alkyl ester sulfonates, for example of formula R—CH($SO_3$M)-$CH_2$COOR', or the sodium, potassium and ammonium alkyl ester sulfates, for example of formula R—CH($OSO_3$M)—$CH_2$COOR', where R represents a $C_{10}$-

$C_{20}$ and preferably $C_{10}$-$C_{16}$ linear or branched alkyl radical, R' represents a $C_1$-$C_6$ and preferably $C_1$-$C_3$ alkyl radical, and M represents a sodium, potassium or the ammonium cation.

Especially preferred for the practice of the present invention are anionic surfactant systems containing $C_{10}$-$C_{20}$ linear alkyl benzene sulphonates, $C_{10}$-$C_{20}$ linear or branched alkylethoxy sulfates having an average degree of ethoxylation ranging from about 0.1 to about 5 (preferably from about 0.3 to about 4 and more preferably from about 0.5 to about 3, which is particularly advantageous for improving the sudsing profile of the detergent composition), or mixtures thereof. The anionic surfactants can be provided in the cleaning compositions of the present invention at levels ranging from about 1% to about 80%, more preferably from about 1% to about 50%, and more preferably from about 5% to about 30% by total weight of the compositions.

In one particularly preferred embodiment, the cleaning composition of the present invention is a liquid laundry or dish detergent composition containing from about 1 wt % to about 50 wt % of one or more anionic surfactants selected from the group consisting of $C_{10}$-$C_{20}$ linear alkyl benzene sulphonates, $C_{10}$-$C_{20}$ linear or branched alkylethoxy sulfates having an average degree of ethoxylation ranging from 0.1 to 5.0, $C_{10}$-$C_{20}$ linear or branched alkyl sulfates, $C_{10}$-$C_{20}$ linear or branched alkyl ester sulfates, $C_{10}$-$C_{20}$ linear or branched alkyl sulphonates, $C_{10}$-$C_{20}$ linear or branched alkyl ester sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and combinations thereof. More preferably, said one or more anionic surfactants are selected from the group consisting of $C_{10}$-$C_{20}$ linear alkyl benzene sulphonates, $C_{10}$-$C_{20}$ linear or branched alkylethoxy sulfates having an average degree of ethoxylation ranging from about 0.5 to about 3, methyl ester sulfonates with a $C_{10}$-$C_{20}$ linear or branched alkyl group, and combinations thereof, and are present in an amount ranging from about 5 wt % to about 30 wt % of the liquid laundry or dish detergent composition.

Water-soluble salts of the higher fatty acids, i.e., "soaps", are also useful anionic surfactants in the cleaning compositions of the present invention. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. However, the cleaning compositions of the present invention preferably contains soaps at a relatively low level, e.g., no more than about 3 wt %, more preferably not more than about 2 wt % or 1 wt %, and most preferably said cleaning composition is essentially free of soaps.

Nonionic surfactants can also be included into the surfactant systems of the present invention, which include those of the formula $R^1(OC_2H_4)_nOH$, wherein $R^1$ is a $C_8$-$C_{18}$ alkyl group or alkyl phenyl group, and n is from about 1 to about 80. Particularly preferred are $C_8$-$C_{18}$ alkyl alkoxylated alcohols having an average degree of alkoxylation from about 1 to about 20. The nonionic surfactants can be provided in the cleaning compositions at levels ranging from about 0.05 wt % to about 20 wt %, preferably from about 0.1 wt % to about 10 wt %, and most preferably from about 1 wt % to about 5 wt %. However, in certain preferred embodiments of the present invention, the cleaning compositions contains nonionic surfactants at a relatively low level, e.g., no more than about 3 wt %, more preferably not more than about 2 wt % or 1 wt %, and most preferably said cleaning composition is essentially free of nonionic surfactants.

Other surfactants useful herein include amphoteric surfactants, zwitterionic surfactants and cationic surfactants. Such surfactants are well known for use in laundry or dish detergents and are typically present at levels from about 0.2 wt %, 0.5 wt % or 1 wt % to about 10 wt %, 20 wt % or 30 wt %.

In a preferred but not necessary embodiment of the present invention, the cleaning composition is a liquid dish detergent composition containing from about 0.5 wt % to about 20 wt % of one or more amphoteric and/or zwitterionic surfactants.

Preferred amphoteric surfactants are selected from the group consisting of amine oxide surfactants, such as, for example, alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides are characterized by a formula $R_1$—$N(R_2)(R_3)$—O, wherein $R_1$ is a $C_{8-18}$ alkyl, and wherein $R_2$ and $R_3$ are independently selected from the group consisting of $C_{1-3}$ alkyls and $C_{1-3}$ hydroxyalkyls, such as methyl, ethyl, propyl, isopropyl, 2-hydroxethyl, 2-hydroxypropyl and 3-hydroxypropyl. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from about 10 to about 24 carbon atoms, preferably from about 12 to about 20, and more preferably from about 10 to about 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least about 50 wt %, more preferably at least about 75 wt % to about 100 wt %, of the mid-branched amine oxides for use herein. Particularly preferred amphoteric surfactants are $C_{10}$-$C_{14}$ alkyl dimethyl amine oxides.

Preferred zwitterionic surfactants are betaine surfactants, such as, for example, alkyl betaines, alkylamidobetaines, amidazoliniumbetaines, sulfobetaines (also referred to as sultaines) as well as phosphobetaines. A particularly preferred betaine is cocoamidopropylbetaine.

The liquid detergent composition as described herein above may also contain an external structurant, which may be present in an amount ranging from about 0.001% to about 1.0%, preferably from about 0.05% to about 0.5%, more preferably from about 0.1% to about 0.3% by total weight of the composition. Suitable external structurants include those described, for example, in US2007/169741 and US2005/0203213. A particularly preferred external structurant for the practice of the present invention is hydrogenated castor oil, which is also referred to as trihydroxylstearin and is commercially available under the tradename Thixin®.

In yet another preferred embodiment of the present invention, the liquid detergent composition further contains from about 0.1 wt % to about 5 wt %, preferably from about 0.5 wt % to about 3 wt %, more preferably from about 1 wt % to about 1.5 wt %, of one or more fatty acids and/or alkali salts thereof. Suitable fatty acids and/or salts that can be used in the present invention include $C_{10}$-$C_{22}$ fatty acids or alkali salts thereof. Such alkali salts include monovalent or divalent alkali metal salts like sodium, potassium, lithium and/or magnesium salts as well as the ammonium and/or alkylammonium salts of fatty acids, preferably the sodium salt.

The balance of the cleaning composition of the present invention typically contains from about 5 wt % to about 70 wt %, or about 10 wt % to about 60 wt % adjunct ingredients.

Suitable adjunct ingredients for laundry detergent products include: builders, chelating agents, dye transfer inhibiting agents, dispersants, rheology modifiers, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, structure elasticizing agents, fabric softeners, carriers, hydrotropes, processing aids, solvents, hueing agents, anti-microbial agents, free perfume oils, and/or pigments. In addition to the disclosure below, suitable examples of such other adjunct ingredients and levels of use are found in U.S. Pat. Nos. 5,576,282, 6,306,812, and 6,326,348. The precise nature of these adjunct ingredients and the levels thereof in the liquid laundry detergent composition will depend on factors like the specific type of the composition and the nature of the cleaning operation for which it is to be used.

Suitable adjunct ingredients for dish detergent products include: builders, chelants, conditioning polymers, cleaning polymers, surface modifying polymers, soil flocculating polymers, structurants, emmolients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, organic and inorganic cations such as alkaline earth metals such as Ca/Mg-ions and diamines, antibacterial agents, preservatives and pH adjusters and buffering means.

If the cleaning composition of the present invention is provided in a powder form, it may also be especially preferred for the powder to comprise low levels, or even be essentially free, of builder. The term "essentially free" means that the composition "comprises no deliberately added" amount of that ingredient. In a preferred embodiment, the cleaning composition of the present invention comprises no builder.

Method of Making the Cleaning Composition

Incorporation of the above-described components and various other ingredients as described hereinabove into the cleaning compositions of the invention can be done in any suitable manner and can, in general, involve any order of mixing or addition.

For example, the alkoxylated polyalkyleneimine(s), the organomodified silicone, the siloxane-based diluent, the hydrophobically modified silica, the silicone resin and the solvent as received from the manufacturer can be mixed first with a surfactant, such as an alkylalkoxy sulfate and preferably an alkylethoxy sulfate having a weight average degree of ethoxylation ranging from about 0.1 to about 5.0, to form a foam control or antifoam composition, which is then mixed with two or more of the other components to form the final detergent or cleaning composition. In another example, the alkoxylated polyalkyleneimine(s), the organomodified silicone, the siloxane-based diluent, the hydrophobically modified silica, the silicone resin, and the solvent can be simultaneously mixed with two or more of the other components to form the final cleaning composition in one mixing step. In yet another example, the alkoxylated polyalkyleneimine(s) can be premixed with an emulsifier, a dispersing agent or a suspension agent to form an emulsion, a latex, a dispersion, a suspension, and the like, which is then mixed with a foam control composition formed by premixing the organomodified silicone, the siloxane-based diluent, the hydrophobically modified silica, the silicone resin, and the solvent, followed by yet another mixing step with other components to form the final cleaning composition. These components can be added in any order and at any point in the process of preparing the final composition.

Methods of Using the Cleaning Composition

The present invention in one aspect is directed to a method of using the above-described cleaning composition to clean fabric, the method comprising the steps of: (i) providing a cleaning composition as described above; (ii) forming a laundry liquor by diluting the cleaning composition with water; (iii) washing fabric in the laundry liquor; and (iv) rinsing the fabric in water, wherein after 2 or less rinses, preferably after 1 rinse, the laundry liquor is substantially free of suds, or at least about 75%, preferably at least about 85%, more preferably about 95%, and even more preferably at least about 99% of a surface area of the laundry liquor is free from suds. The method of cleaning fabric may be carried out in a top-loading or front-loading automatic washing machine, or can be used in a hand-wash laundry application, which is particularly preferred in the present invention.

The present invention in another aspect is directed to a method of using the above-described cleaning composition to clean dishes. Said method comprises the step of applying the cleaning composition, preferably in liquid form, onto a dish surface, either in diluted form or neat form, followed by rinsing. By "neat form," it is meant that the cleaning composition is applied directly onto the dish surface to be treated and/or onto a cleaning device such as a dish cloth, a sponge or brush, without undergoing any dilution immediately prior to the application. By "diluted form," it is meant that the cleaning composition is diluted by the user with an appropriate solvent, typically water.

Test Methods

Various techniques are known in the art to determine the properties of the compositions of the present invention comprising the cationic polymer. However, the following assays must be used in order that the invention described and claimed herein may be fully understood.

Test 1: Solubility Index Test—Measuring the Miscibility or Solubility of Materials in Organomodified Silicones Via UV-Vis % Transmittance The Solubility Index is determined by measuring the percentage of light transmittance through samples using a UV-Vis Spectrophotometer operated in transmission mode, at 480 nm, using 1 cm path length cuvettes, in accordance with the following procedure. Suitable instruments include the Beckman Coulter model DU 800 UV-Vis Spectrophotometer (Beckman Coulter Inc., Brea, Calif., USA).

All sample preparations and analyses are conducted in a laboratory with air temperature of 22° C.+/−2° C. In a glass scintillation vial combine the predominant organocompatible silicone present in the composition, along with the material to be tested (for example, a polydimethyl siloxane polymer), at the ratio of 80:20 vol/vol. Cap the vial, and mix the materials thoroughly for 5 minutes using a benchtop vortex mixer set to its highest speed. If two or more distinct layers of materials are clearly visible by eye in the vial after mixing, then the Solubility Index of the test material is considered to be indeterminate via this method. If distinct layers are not clearly visible by eye, then continue with the analysis.

Turn on the spectrophotometer lamps and allow them to warm up for 30 minutes prior to commencing measurements. Set the instrument to collect the measurement in Percentage Transmission (% T) mode, at a wavelength of 480 nm. Load all samples into 1 cm path length plastic cuvettes. If air bubbles are visible in the cuvettes, use a pipette to remove the bubbles, or let the bubbles settle out of the cuvette prior to measurement.

Zero the baseline for a neat sample of the organocompatible silicone by using a cuvette loaded with deionized (DI) water along with a cuvette loaded with the neat silicone. Measure the % T of the neat organocompatible silicone. Measure the % T of the mixture of organocompatible silicone and test sample, as prepared under the previous instructions. Compare the % T of the mixture of organocompatible silicone and test sample, to the % T of the neat organomodified silicone (which was measured using a DI water blank as a baseline).

The Solubility Index is reported as a decimal number, and is calculated as the % T of the mixture of organocompatible silicone and test sample, divided by the % T of the neat organocompatible silicone. For example, Solubility Index of a specific Test Sample A=% T of ABC in Organocompatible Silicone/% T of the Organocompatible Silicone=85%/98%=0.867

EXAMPLES

Example 1: Silicone Antifoam Agent A1

Silicone antifoam agent A1 is prepared by charging a 250 ml container equipped with a stirrer with 71.14 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1], and 3.8 g of an organosiloxane resin[2] having trimethyl siloxane units and $SiO_2$ units in a M/Q ratio of about 0.65/1 to 0.67/1 dissolved in 20.06 g of 10 cSt. polydimethylsiloxane[3]. The mixture is stirred until complete incorporation of the resin mixture. Then 5.00 g of precipitated silica[5] and is added and the mixture stirred until complete incorporation of the silica is achieved.

Example 2: Silicone Antifoam Agent B1

Silicone antifoam agent B1 is prepared by charging a 250 ml container equipped with a stirrer with 69.05 g of a polymer having a molecular weight of approximately 65,000 and comprising 71-75 mole % dimethylsiloxane groups, 20-24 mole % 2-phenylpropylmethylsiloxane groups, 3-7 octylmethylsiloxane groups and terminated with a trimethylsilyl group[1], and 2.25 g of an organosiloxane resin[2] having trimethyl siloxane units and $SiO_2$, units in a M/Q ratio of about 0.65/1 to 0.67/1 dissolved in 23.70 g of 10 cSt. polydimethylsiloxane[3]. The mixture is stirred until complete incorporation of the resin mixture. Then 5.00 g of precipitated silica[5] and is added and the mixture stirred until complete incorporation of the silica is achieved.

Example 3: Silicone Antifoam Agent C1

Silicone antifoam agent C1 is prepared by charging a 250 ml container equipped with a stirrer with 67.68 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1], and 2.25 g of an organosiloxane resin[2] having trimethyl siloxane units and $SiO_2$ units in a M/Q ratio of about 0.65/1 to 0.67/1 dissolved in 22.55 g of 10 cSt. polydimethylsiloxane[3]. The mixture is stirred until complete incorporation of the resin mixture. Then 7.52 g of precipitated silica[5] and is adder and the mixture stirred until complete incorporation of the silica is achieved.

Example 4: Silicone Antifoam Agent D1

Silicone antifoam agent D1 is prepared by charging a 250 ml container equipped with a stirrer with 70.56 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1], 3.80 g of an organosiloxane resin[2] having trimethyl siloxane units and $SiO_2$ units in a M/Q ratio of about 0.65/1 to 0.67/1 dissolved in 3.00 g of 2-ethylhexyl stearate[4] and 17.64 g of 10 cSt. polydimethylsiloxane[3]. The mixture is stirred until complete incorporation of the resin mixture. Then 5.00 g of precipitated silica[5] led and the mixture stirred until complete incorporation of the silica is achieved.

Example 5: Silicone Antifoam Agent E1

Silicone antifoam agent E1 is prepared by charging a 250 ml container equipped with a stirrer with 67.68 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1], and 2.25 g of an organosiloxane resin[2] having trimethyl siloxane units and $SiO_2$ units in a M/Q ratio of about 0.65/1 to 0.67/1 dissolved in 22.55 g of 10 cSt. polydimethylsiloxane[3]. The mixture is stirred until complete incorporation of the resin mixture. Then 5.00 g of precipitated silica[5] and 2.52 g fumed silica[6] is added and the mixture stirred until complete incorporation of the silica is achieved.

Example 6: Silicone Antifoam Agent F1

Silicone antifoam agent F1 is prepared by charging a 250 ml container equipped with a stirrer with 42.70 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1], 2.40 g of an organosiloxane resin[2] having trimethyl siloxane units and $SiO_2$ units in a M/Q ratio of about 0.65/1 to 0.67/1 dissolved in 2.40 g of 2-ethylhexyl stearate[4], 28.50 g of 10 cSt. polydimethylsiloxane[3] and 20.00 g of 7 cSt. polydimethylsiloxane[7]. The mixture is stirred until complete incorporation of the resin mixture. Then 4.00 g of precipitated silica[5] is added and the mixture stirred until complete incorporation of the silica is achieved.

Example 7: Silicone Antifoam Agent G1

Silicone antifoam agent G1 is prepared by charging a 250 ml container equipped with a stirrer with 65.52 g of a polymer having a molecular weight of approximately 65,000 and comprising 71-75 mole % dimethylsiloxane groups, 20-24 mole % 2-phenylpropylmethylsiloxane groups, 3-7 mole % octylmethylsiloxane groups and terminated with a trimethylsilyl group[1] and 6.0 g of an organosiloxane resin[2] having trimethyl siloxane units and $SiO_2$ units in a M/Q ratio of about 0.65/1 to 0.67/1. The mixture is stirred until complete incorporation of the resin. Then 5.25 g of Sipernat 35 precipitated silica[5] and 1.75 g of Aerosil 200 fumed silica[5] is added and the mixture stirred until complete incorporation of the silica is achieved. Then 0.79 g of potassium methoxide is added and the mixture is stirred for 4 hours at 200° C., cooled to ambient and 18.48 g of 10 cSt. polydimethylsiloxane[3] and 3.00 g of 2-ethylhexylstearate is added and stirred until complete incorporation is achieved, yielding a viscous semi-transparent liquid.

Example 8: Silicone Antifoam Agent H1

Silicone antifoam agent H1 is prepared by charging a 250 ml container equipped with a stirrer with 70.56 g of a polymer having a molecular weight of approximately 65,000 and comprising 71-75 mole % dimethylsiloxane groups, 27-33 mole % 2-phenylpropylmethylsiloxane groups, 3-7 mole % octylmethylsiloxane groups and terminated with a trimethylsilyl group[1], 3.80 g of an organosiloxane resin[2] having trimethyl siloxane units and $SiO_2$ units in a M/Q ratio of about 0.65/1 to 0.67/1 dissolved in 3.00 g of 2-ethylhexyl stearate[4] and 17.64 g of 10 cSt. polydimethylsiloxane[3]. The mixture is stirred until complete incorporation of the resin mixture. Then 5.00 g of precipitated silica[5] is added and the mixture stirred until complete incorporation of the silica is achieved.

[1]Supplied by Shin-Etsu Silicones of America, Akron, Ohio

[2]Supplied by Wacker Silicones, Adrian, Mich. under the trade name Belsil® 803

[3]Supplied by Shin-Etsu Silicones of America, Akron, Ohio

[4]Supplied by Wako Chemicals USA, Inc, Richmond, Va.

[5]Available from Evonik Degussa Corporation, Parsippany, N.J.

[6]Available from Evonik Degussa Corporation, Parsippany, N.J.

[7]Available from Gelest, Inc., Morrisville, Pa.

Example 9: Synergistically Improved Rinse Suds Profile Achieved by the Combination of Alkoxylated Polyalkoxyleneimine (PEI) with Silicone Antifoam Agent (SA)

Four (4) sample liquid laundry detergent compositions are prepared, which include: (A) a control composition that does not contain any alkoxylated polyalkoxyleneimine or any antifoam premix; (B) a first comparative composition formed by adding an alkoxylated polyalkoxyleneimine of the present invention into the control composition, but without any antifoam premix; (C) a second comparative composition formed by adding the silicone antifoam agent D1 of Example 4 into the control composition, but without any alkoxylated polyalkoxyleneimine; and (D) an invention composition formed by adding an alkoxylated polyalkoxyleneimine of the present invention and the silicone antifoam agent 1 of Example 4 into the control composition. Detailed compositional breakdown of these four sample compositions are listed as follows in Table I:

TALBE I

| | Sample Detergent Compositions | | | |
|---|---|---|---|---|
| Ingredients (wt %) | (A) Control | (B) Control + PEI | (C) Control + SA | (D) Control + PEI + SA |
| $C_{12-14}AE_{1-3}S$ | 7.88 | 7.88 | 7.88 | 7.88 |
| $C_{11-13}LAS$ | 4.59 | 4.59 | 4.59 | 4.59 |
| Neodol ®25-7 a | 0.61 | 0.61 | 0.61 | 0.61 |
| $C_{12-14}$ alkyl dimethyl amine oxide | 0.3 | 0.3 | 0.3 | 0.3 |
| Citric acid | 2 | 2 | 2 | 2 |
| Boric acid | 1.2 | 1.2 | 1.2 | 1.2 |
| $C_{12}$-$C_{18}$ fatty acid | 1 | 1 | 1 | 1 |
| Na-DTPA b | 0.2 | 0.2 | 0.2 | 0.2 |
| 1,2 propanediol | 2 | 2 | 2 | 2 |
| Sodium cumene sulphonate | 0 | 0 | 0 | 0 |
| Silicone (PDMS) emulsion | 0.0025 | 0.0025 | 0.0025 | 0.0025 |
| Monoethanolamine | 0.096 | 0.096 | 0.096 | 0.096 |
| NaOH | Up to pH 8 | Up to pH 8 | Up to pH 8 | Up to pH 8 |
| Brightener | 0.06 | 0.06 | 0.06 | 0.06 |
| Neat perfume oil | 0.55 | 0.55 | 0.55 | 0.55 |
| Polyethyleneimine ethoxylate ($PEI_{600}EO_{24}PO_{16}$) | 0 | 2 | 0 | 2 |
| Silicone Antifoam Agent (SA) D1 of Example 4 | 0 | 0 | 0.15 | 0.15 |
| Hydrogenated castor oil | 0.12 | 0.12 | 0.12 | 0.12 |
| Water | Balance | Balance | Balance | Balance |

These four sample compositions are used to hand wash fabrics, in order to observe the suds profile generated thereby during the hand-washing process. For each sample composition, the following hand washing test protocols are followed:

First, a red plastic basin of 40 cm in diameter and 19 cm in depth is filled with 5 liters of water at room temperature that has a water hardness of 12 gpg and a Ca/Mg ratio of 4:1. Twenty five (25) grams of the sample liquid detergent composition is weighed and poured into the basin. The wash solution is stirred by hand in a circular motion for 10 times to ensure full dissolution. The fabrics load to be washed by each sample liquid detergent composition include: (1) 4 pieces of knitted cotton of 40 cm×40 cm in size and 125 g in weight, (2) a soiled cotton swatch with the desired size of 10.5 cm×10.5 cm carrying 0.4 gram of clay particulates, and (3) a dirty white cotton shirt of 190 grams in weight collected from a consumer panel. The shirts tested are all of the same brand and size and are worn by consumer panels during the same period of time. Dirty shirts are selected with similar soil level on collars to minimize variation.

Each knitted cotton piece, the soiled cotton swatch are washed by hands with 10 times of scrubbing. The dirty shirt is washed by hand with 20 times of scrubbing on the collar, and 10 times of scrubbing on the torso section of the shirt. At the end of the wash, the height of suds on the wash liquor surface is measured with a ruler.

Subsequently, the 4 pieces of knitted cotton, the cotton swatch and the shirt are removed from the wash liquor and squeezed to reach a carry-over liquid weight of 990 g (i.e. 1440 g for total wet fabrics).

To start the first rinse, the squeezed fabric load is placed into a rinse basin containing 7 L of water having the same hardness as described hereinabove. Three times of scrubbing are applied onto each piece of fabric. After removal of the fabric, a picture is taken from the top of the rinse basin. Suds floating on the surface of the rinsing liquor can be classified into three different suds coverage categories: (i) dense layer (opaque white, the red basin bottom is blocked from sight); (ii) thin layer (translucent white, the red basin bottom is vaguely visible), (iii) water layer (clear water, the basin bottom is clearly visible). These three categories of suds coverage render distinct intensity in grayscale imaging. The denser the suds, the lighter the imaging intensity. The rinse suds image is processed by an imaging analyzing software to calculate the surface area of the dense suds layer (i), by counting the number of pixels lighter than a defined threshold which corresponds to the area where dense suds is present on the rinsing liquor surface. The smaller the calculated surface area of the dense suds layer, the more efficient is the sample composition in reducing suds during the rinse.

Following Table II contains the calculated surface area (% over the entire basin surface area) of the dense suds layer after rinse for each of the four (4) sample liquid laundry detergent compositions tested. Further, the measured results of the comparative samples (B) and (C) as well as the inventive sample (D) are normalized over that of the control sample (A) to provide a relative rinse suds reduction index (ΔE), which is calculated as the dense rinse suds surface area of the sample composition minus the dense rinse suds surface area of the control composition.

TABLE II

| | (A) Control | (B) Control + PEI | (C) Control + SA | (D) Control + PEI + SA |
|---|---|---|---|---|
| Dense Rinse Suds Surface Area (%) | 45 | 19 | 41 | 2 |
| ΔE (%) | 0 | 26% | 4% | 43% |

It is clear from the above results that the alkoxylated polyalkyleneimine of the present invention and the silicone antifoam agent containing the organomodified silicone and the siloxane-based diluent act together to reduce rinse suds of the control liquid laundry detergent composition in a synergistic manner.

Example 10: Exemplary Liquid Laundry Detergent Compositions

Liquid laundry detergent compositions 10A-10E are made by mixing together the ingredients listed in the proportions shown:

| Ingredient (wt %) | 10A | 10B | 10C | 10D | 10E |
|---|---|---|---|---|---|
| $C_{12}$-$C_{15}$ alkyl polyethoxylate (1.8) sulfate[1] | 20.1 | 16.6 | 14.7 | 13.9 | 8.2 |
| $C_{11.8}$ linear alkylbenzene sulfonc acid[2] | — | 4.9 | 4.3 | 4.1 | 8.2 |
| $C_{16}$-$C_{17}$ branched alkyl sulfate[1] | — | 2.0 | 1.8 | 1.6 | — |
| $C_{12}$ alkyl trimethyl ammonium chloride[4] | 2.0 | | — | — | — |
| $C_{12}$ alkyl dimethyl amine oxide[5] | | 0.7 | 0.6 | — | — |
| $C_{12}$-$C_{14}$ alcohol 9 ethoxylate[3] | 0.3 | 0.8 | 0.9 | 0.6 | 0.7 |
| $C_{15}$-$C_{16}$ branched alcohol-7 ethoxylate[1] | — | — | — | — | 4.6 |
| 1,2 Propane diol[6] | 4.5 | 4.0 | 3.9 | 3.1 | 2.3 |
| Ethanol | 3.4 | 2.3 | 2.0 | 1.9 | 1.2 |
| $C_{12}$-$C_{18}$ Fatty Acid[5] | 2.1 | 1.7 | 1.5 | 1.4 | 3.2 |
| Citric acid[7] | 3.4 | 3.2 | 3.5 | 2.7 | 3.9 |
| Protease[7] (32 g/L) | 0.42 | 1.3 | 0.07 | 0.5 | 1.12 |
| Fluorescent Whitening Agent[8] | 0.08 | 0.2 | 0.2 | 0.17 | 0.18 |
| Diethylenetriamine pentaacetic acid[6] | 0.5 | 0.3 | 0.3 | 0.3 | 0.2 |
| Zwitterionic ethoxylated quaternized sulfated hexamethylene diamine[11] | — | 1.5 | — | — | 0.8 |
| Hydrogenated castor oil[12] | 0.2 | 0.2 | | 0.12 | 0.3 |
| Alkoxylated Polyalkylenimine Polymer I[9] | 0-4 | 1.8 | 1.5 | 1.0 | — |
| Alkoxylated Polyalkylenimine Polymer II[10] | 0.5-5 | — | 1.3 | 1.8 | 2.0 |
| Silicone Antifoam Agent A1-H1 | 0.2 | 0.3 | 0.15 | 0.25 | 0.4 |
| Water, perfumes, dyes, buffers, solvents and other optional components | to 100% pH 8.0-8.2 | to 100% pH 8.0-8.2 | to 100% pH 8.0-8.2 | to 100% pH 8.0-8.2 | to 100% pH 8.0-8.2 |

[1]Available from Shell Chemicals, Houston, TX.

[2]Available from Huntsman Chemicals, Salt Lake City, UT.

[3]Available from Sasol Chemicals, Johannesburg, South Africa

[4]Available from Evonik Corporation, Hopewell, VA.

[5]Available from The Procter & Gamble Company, Cincinnati, OH.

[6]Available from Sigma Aldrich chemicals, Milwaukee, WI

[7]Available from Genencor International, South San Francisco, CA.

[8]Available from Ciba Specialty Chemicals, High Point, NC

[9]600 g/mol molecular weight polyethylenimine core with 20 ethoxylate groups per —NH and available from BASF (Ludwigshafen, Germany).

[10]600 g/mol molecular weight polyethylenimine core with 24 ethoxylate groups per —NH and 16 propoxylate groups per —NH. Available from BASF (Ludwigshafen, Germany).

[11]Described in WO 01/05874 and available from BASF (Ludwigshafen, Germany)

[12]Available under the tradename ThixinR from Elementis Specialties, Highstown, NJ Example 11: Liquid or Gel Detergents Liquid or gel fabric care detergent compositions 11A-11E are prepared by mixing the ingredients listed in the proportions shown:

| Ingredient (wt %) | 11A | 11B | 11C | 11D | 11E |
|---|---|---|---|---|---|
| $C_{12}$-$C_{15}$ alkyl polyethoxylate (3.0) sulfate[1] | 8.5 | 2.9 | 2.9 | 2.9 | 6.8 |
| $C_{11.8}$ linear alkylbenzene sulfonic acid[2] | 11.4 | 8.2 | 8.2 | 8.2 | 1.2 |
| $C_{14}$-$C_{15}$ alkyl 7-ethoxylate[1] | — | 5.4 | 5.4 | 5.4 | 3.0 |
| $C_{12}$-$C_{14}$ alkyl 7-ethoxylate[3] | 7.6 | — | — | — | 1.0 |
| 1,2 Propane diol | 6.0 | 1.3 | 1.3 | 6.0 | 0.2 |
| Ethanol | — | 1.3 | 1.3 | — | 1.4 |
| Diethylene Glycol | 4.0 | — | — | — | — |
| Na Cumene Sulfonate | — | 1.0 | 1.0 | 0.9 | — |
| $C_{12}$-$C_{18}$ Fatty Acid[5] | 9.5 | 3.5 | 3.5 | 3.5 | 4.5 |
| Citric acid | 2.8 | 3.4 | 3.4 | 3.4 | 2.4 |
| Protease (40.6 mg/g/)[7] | 1.0 | 0.6 | 0.6 | 0.6 | 0.3 |
| Natalase 200L (29.26 mg/g)[13] | — | 0.1 | 0.1 | 0.1 | — |
| Termamyl Ultra (25.1 mg/g)[13] | 0.7 | 0.1 | 0.1 | 0.1 | 0.1 |
| Mannaway 25L (25 mg/g)[13] | 0.1 | 0.1 | 0.1 | 0.1 | 0.02 |
| Whitezyme (20 mg/g)[13] | 0.2 | 0.1 | 0.1 | 0.1 | — |
| Fluorescent Whitening Agent[8] | 0.2 | 0.1 | 0.1 | 0.1 | — |
| Diethylene Triamine Penta Methylene Phosphonic acid | — | 0.3 | 0.3 | 0.3 | 0.1 |
| Hydroxy Ethylidene 1,1 Di Phosphonic acid | 1.5 | — | — | — | — |
| Zwitterionic ethoxylated quaternized sulfated hexamethylene diamine[11] | 2.1 | 1.0 | 1.0 | 1.0 | 0.7 |
| PEG-PVAc Polymer[14] | 0.9 | 0.5 | 0.5 | 0.5 | — |
| Hydrogenated castor oil[12] | 0.8 | 0.4 | 0.4 | 0.4 | 0.3 |
| Borate | — | 1.3 | — | — | 1.2 |
| 4 Formyl Phenyl Boronic Acid | — | — | 0.025 | — | — |
| Alkoxylated Polyalkyleneimine I[9] | 0-4 | 1.8 | 1.5 | 1.0 | — |
| Alkoxylated Polyalkyleneimine II[10] | 0.5-5 | — | 1.3 | 1.8 | 2.0 |
| Silicone Antifoam Agent A1-H1 | 0.4 | 0.3 | 0.3 | 0.2 | 0.3 |
| Water, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 |

[13]Available from Novozymes, Copenhagen, Denmark.

[14]PEG-PVA graft copolymer is a polyvinyl acetate grafted polyethylene oxide copolymer available from BASF (Ludwigshafen, Germany), having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60.

Example 12: Rinse-Added Fabric Care Compositions

Rinse-Added fabric care compositions 12A-12D are prepared by mixing together ingredients shown below:

| Ingredients (wt %) | 12A | 12B | 12C | 12D |
|---|---|---|---|---|
| Fabric Softener Active[15] | 16.2 | 11.0 | 16.2 | — |
| Fabric Softener Active[16] | — | — | — | 5.0 |
| Cationic Starch[17] | 1.5 | — | 1.5 | — |
| Quaternized polyacrylamide[18] | — | | 0.25 | 0.25 |
| Calcium chloride | 0.15 | 0. | 0.15 | — |
| Ammonium chloride | 0.1 | 0.1 | 0.1 | — |
| Alkoxylated Polyalkyleneimine I[9] | 0-4 | 1.8 | 1.5 | — |
| Alkoxylated Polyalkyleneimine II[10] | 0.5-5 | — | 1.3 | 1.8 |
| Silicone Antifoam Agent A1-H1 | 0.2 | 0.15 | 0.25 | 0.3 |
| Perfume | 0.85 | 2.0 | 0.85 | 1.0 |

-continued

| Ingredients (wt %) | 12A | 12B | 12C | 12D |
|---|---|---|---|---|
| Perfume microcapsule[19] | 0.65 | 0.75 | 0.65 | 0.3 |
| Water, suds suppressor, stabilizers, pH control agents, buffers, dyes & other optional ingredients | to 100% pH = 3.0 | to 100% pH = 3.0 | to 100% pH = 3.0 | to 100% pH = 3.0 |

[15]N,N di(tallowoyloxyethyl)-N,N dimethylammonium chloride available from Evonik Corporation, Hopewell, VA.

[16]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N-hydroxyethyl N,N-dimethylammonium chloride available from Evonik Corporation, Hopewell, VA.

[17]Cationic starch based on common maize starch or potato starch, containing 25% to 95% amylose and a degree of substitution of from 0.02 to 0.09, and having a viscosity measured as Water Fluidity having a value from 50 to 84. Available from National Starch, Bridgewater, NJ.

[18]Cationic polyacrylamide polymer such as a copolymer of acrylamide/[2-(acryloylamino) ethyl]tri-methylammonium chloride (quaternized dimethyl aminoethyl acrylate) available from BASF, AG, Ludwigshafen under the trade name Sedipur 544.

[19]Available from Appleton Paper of Appleton, WI.

Example 13: Powder Laundry Detergent Compositions

Powder laundry detergent compositions 13A-13C are prepared by mixing together ingredients shown below:

| Ingredient (wt %) | 13A | 13B | 13C |
|---|---|---|---|
| LAS (Non-sulphated anionic surfactant) | 10 | 15-16 | 7 |
| Mixture of alkyl sulphate surfactants | 1.5 | 1.5-2 | 1.5 |
| Cationic surfactant | 0-1 | 0-1.5 | 0-1 |
| Non-ionic surfactant | 0-1 | 0-1.5 | 0-1 |
| Zeolite | 0-3 | 6-10 | 0-3 |
| Bleach and bleach activator | 0-5 | 4-6 | 2-3 |
| Silicate | 7-9 | — | 5-6 |
| Carbonate | 10-30 | 25-35 | 15-30 |
| Sulfate | 30-70 | 30-35 | 40-70 |
| Alkoxylated polyalkyleneimine I and/or II | 0.5-5 | 1-4 | 2-3 |
| Silicone antifoam agent A1-H1 | 0.1-2 | 0.15-1 | 0.2-0.5 |
| Deionized water | Balance to 100 wt % | | |

Example 14: Liquid Dish Detergent Compositions

Liquid dish detergent compositions 14A-13G are prepared by mixing together ingredients shown below:

| Ingredients (wt %) | 14A | 14B | 14C | 14D | 14E | 14F | 14G |
|---|---|---|---|---|---|---|---|
| Alkyl $C_{10-14}$ Ethoxy Sulphate (AE0.6S) | 26.9 | — | — | 25.7 | — | 11.1 | 21.0 |
| Alkyl $C_{10-14}$ Ethoxy Sulphate (AE2S) | — | 18.7 | 26.9 | — | 18.7 | — | — |
| Sodium alkyl benzene sulfonate | — | 8.0 | — | — | — | — | — |
| Sodium paraffin sulfonate | — | — | — | — | 8.0 | — | — |
| C12-14 dimethyl amine oxide | 6.1 | — | — | 4.1 | — | 3.7 | 10.0 |
| Cocamido propyl betaine | — | 4.5 | 6.8 | 3.2 | 6.0 | — | — |
| C12-13 EO7 nonionic | — | — | — | — | — | 1.0 | 2.0 |
| Branched Nonionic: 3-propyl heptanol EO8 | 1.0 | 0.8 | — | — | — | — | 1.0 |
| Ethanol | 4.0 | 5.0 | 3.0 | 3.0 | 2.0 | — | 3.0 |
| Polypropylene glycol MW2000 | 1.1 | 0.8 | 1.1 | 1.1 | 1.1 | 0.5 | 1.1 |
| Sodium Chloride | 1.3 | 0.8 | 1.3 | 0.5 | 0.8 | 1.3 | 1.3 |
| Alkoxylated Polyalkyleneimine I | 0-4 | 1.0 | 2 | 1.0 | 1.3 | — | — |
| Alkoxylated Polyalkyleneimine II | 0.5-5 | — | — | 1.5 | 1.5 | 2 | 4 |
| Silicone Antifoam Agent A1-H1 | 0.1-2 | 0.15 | 0.25 | 0.3 | 0.2 | 0.15 | 0.25 |
| Minors* and water | to balance up to 100% | | | | | | |

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition comprising:

(a) at least one alkoxylated polyalkyleneimine comprising a polyalkyleneimine core and at least one side chain bonded to a nitrogen atom in the polyalkyleneimine core, wherein the polyalkyleneimine core has an average number-average molecular weight (MWn) ranging from 100 to 100,000 Daltons, and wherein said at least one side chain has an empirical formula (I) of:

$$-(EO)_b(PO)_c—R \quad (I)$$

wherein: EO is ethylene oxide; b has a weight average value ranging from 3 to 60; PO is propylene oxide; c has a weight average value ranging from 0 to 60; R is selected from the group consisting of hydrogen, $C_1$-$C_4$ alkyls, and combinations thereof;

(b) an organomodified silicone comprising one or more aryl moieties each comprising a 5- to 9-membered aromatic ring, wherein said aromatic ring can be either substituted or unsubstituted, either heteroatomic or homoatomic, either monocyclic or multicyclic; and (c) from about 0.001 wt % to about 10 wt % of a siloxane-based diluent comprising a first polydimethylsiloxane having a first, higher viscosity and a second polydimethylsiloxane having a second, lower viscosity, and wherein the weight ratio of said first polydimethylsiloxane to said second polydimethylsiloxane is greater than 1:1, said diluent having a Solubility Index of from 0.8 to 1.25 in said organomodified silicone.

2. The cleaning composition of claim 1, comprising a first alkoxylated polyalkyleneimine having a polyalkyleneimine core with Mwn ranging from 100 to 5000 Daltons; b ranges from 10 to 50; and wherein c ranges from 1 to 50.

3. The cleaning composition of claim 2, further comprising a second alkoxylated polyalkyleneimine having a polyalkyleneimine core with Mwn ranging from 100 to 5000 Daltons; b ranges from 5 to 40; and wherein c is 0.

4. The cleaning composition of claim 3, wherein the weight ratio between said first and second alkoxylated polyalkyleneimines ranges from 1:10 to 10:1.

5. The cleaning composition of claim 1, comprising said at least one alkoxylated polyalkyleneimine in an amount ranging from 0.01 wt % to 20 wt %.

6. The cleaning composition of claim 1, wherein the aromatic ring of said one or more aryl moieties in said organomodified silicone is selected from the group consisting of phenyl, furan, pyrrole, thiophene, imidazole, pyrazole, oxazole, pyridine, pyrazine, naphthalene, anthracene moieties, and derivatives thereof.

7. The cleaning composition of claim 1, wherein said organomodified silicone further comprises one or more $C_2$-$C_{20}$ aliphatic moieties.

8. The cleaning composition of claim 1, wherein said organomodified silicone comprises from 1 mol % to 75 mol % of siloxane units containing a 2-phenylpropyl moiety; and from 1 mol % to 20 mol % of siloxane units containing a $C_3$-$C_{30}$ aryl moiety.

9. The cleaning composition of claim 1, comprising said organomodified silicone in an amount ranging from 0.001 wt % to 10 wt %.

10. The cleaning composition of claim 1, wherein said siloxane-based diluent has a Solubility Index of from 0.85 to 1.2 in said organomodified silicone.

11. The cleaning composition of claim 1, wherein said siloxane-based diluent has a viscosity, at a shear rate of 20 $sec^{-1}$ and 25° C., ranging from 0.5 cSt to 10,000 cSt.

12. The cleaning composition of claim 1, wherein the first, higher viscosity ranges from 8 cSt to 12 cSt, and wherein the second, lower viscosity ranges from 5 cSt to 10 cSt, when measured at a shear rate of 20 $sec^{-1}$ and 25° C.

13. The cleaning composition of claim 1, further comprising:

(d) a hydrophobically modified silica, which is present in said cleaning composition in an amount ranging from 0.0001 wt % to 1 wt %;

(e) a silicone resin, which is present in said cleaning composition in amount ranging from 0.0001 wt % to 1 wt %; and (f) optionally, a solvent for the silicone resin that is present in said cleaning composition in an amount ranging from 0 wt % to 0.5 wt %.

14. The cleaning composition of claim 1, further comprising one or more surfactants selected from the group consisting of anionic surfactants, nonionic surfactants, cationic surfactants, amphoteric surfactants, zwitterionic surfactants, and combinations thereof.

15. The cleaning composition of claim 14, comprising from 1 wt % to 50 wt % of one or more anionic surfactants selected from the group consisting of $C_{10}$-$C_{20}$ linear alkyl benzene sulphonates, $C_{10}$-$C_{20}$ linear or branched alkylethoxy sulfates having an average degree of ethoxylation ranging from 0.1 to 5.0, $C_{10}$-$C_{20}$ linear or branched alkyl sulfates, $C_{10}$-$C_{20}$ linear or branched alkyl ester sulfates, $C_{10}$-$C_{20}$ linear or branched alkyl sulphonates, $C_{10}$-$C_{20}$ linear or branched alkyl ester sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and combinations thereof.

16. The cleaning composition of claim 15, further comprising from 0.05 wt % to 20 wt % of one or more nonionic surfactants selected from the group consisting of $C_8$-$C_{18}$ alkyl alkoxylated alcohols having a weight average degree of alkoxylation ranging from 1 to 20 and combinations thereof.

17. The cleaning compositions of claim 15, comprising no more than 3 wt % of soaps and no more than 3 wt % of nonionic surfactants.

18. The cleaning composition of any of claim 15, further comprising from 0.5 wt % to 20 wt % of one or more amphoteric surfactant and/or zwitterionic surfactant.

19. A consumer product comprising the cleaning composition according to claim 1, wherein said consumer product is a fabric and home care product.

20. A liquid detergent composition comprising:

(a) from 1 wt % to 5 wt % of at least one alkoxylated polyalkyleneimine comprising a polyalkyleneimine core and at least one side chain bonded to a nitrogen atom in the polyalkyleneimine core, wherein the polyalkyleneimine core has an average number-average molecular weight (MWn) ranging from 200 to 1000 Daltons, and wherein said at least one side chain has an empirical formula (I) of:

$$-(EO)_b(PO)_c—R \quad (I)$$

wherein: EO is ethylene oxide; b has a weight average value ranging from 20 to 30; PO is propylene oxide; c has a weight average value ranging from 10 to 30; R is hydrogen;

(b) from 0.02 wt % to 0.5 wt % of an organomodified silicone, which comprises from 10 mol % to 40 mol % of siloxane units containing a 2-phenylpropyl moiety and from 3 mol % to 10 mol % of siloxane units containing a $C_6$-$C_{10}$ alkyl moiety;

(c) from 0.02 wt % to 0.5 wt % of a siloxane-based diluent comprising a first polydimethylsiloxane having a first, higher viscosity and a second polydimethylsiloxane having a second, lower viscosity, and wherein the weight ratio of said first polydimethylsiloxane to said second polydimethylsiloxane is greater than 1:1, said diluent having a Solubility Index of from 0.85 to 1 in said organomodified silicone;

(d) from 0.002 wt % to 0.05 wt % of a hydrophobically modified silica;

(e) from 0.002 wt % to 0.05 wt % of a silicone resin;

(f) from 5 wt % to 30 wt % of an anionic surfactant selected from the group consisting of $C_{10}$-$C_{20}$ linear alkyl benzene sulphonates, $C_{10}$-$C_{20}$ linear or branched alkylethoxy sulfates having an average degree of ethoxylation ranging from 0.5 to 3, methyl ester sulfonates with a $C_{10}$-$C_{20}$ linear or branched alkyl group, and combinations thereof;

(g) optionally, from 0.5 wt % to 20 wt % of an amphoteric surfactant and/or a zwitterionic surfactant;

(h) optionally, from 0.1 wt % to 10 wt % of a nonionic surfactant; and (i) water.

21. A method of washing fabric or dishes to achieve optimized rinse suds profile, said method comprising contacting the composition according to claim 1 with said fabric or dishes.

22. The method of claim 21, wherein said contacting comprises handwashing said fabric or dishes.

* * * * *